US006015173A

United States Patent [19]

Shang

[11] Patent Number: 6,015,173

[45] Date of Patent: Jan. 18, 2000

[54] STRUCTURE OF DOOR GUARD

[76] Inventor: Chen Shui Shang, 199 Su Mau Road, Ho Mei Township, Chan Hua Hsien, Taiwan

[21] Appl. No.: 09/246,902

[22] Filed: Feb. 8, 1999

Related U.S. Application Data

[63] Continuation-in-part of application No. 08/993,625, Dec. 18, 1997, abandoned.

[51] Int. Cl.[7] ..... E05C 19/18

[52] U.S. Cl. ..... 292/288; 292/DIG. 15; 292/70; 16/86 R

[58] Field of Search ..... 16/82, 86 A, 86 R, 16/85; 292/DIG. 15, DIG. 18, 288, 70, 90

[56] References Cited

U.S. PATENT DOCUMENTS

| | | | |
|---|---|---|---|
| 2,109,228 | 2/1938 | Carlson . | |
| 2,140,002 | 12/1938 | Dion | 292/70 |
| 2,319,726 | 5/1943 | Duggan . | |
| 2,449,686 | 9/1948 | Brinda | 16/85 |
| 2,454,414 | 11/1948 | Taylor | 292/70 |
| 2,652,585 | 9/1953 | Herbener | 16/86 A |
| 3,042,959 | 7/1962 | Strom | 16/86 A |

*Primary Examiner*—Teri Pham

*Attorney, Agent, or Firm*—Harrison & Egbert

[57] ABSTRACT

A guard for a door having a connection body with a hollow trough formed on an underside thereof. The connection body having a front wall with an inverted U-shaped trough. A fixed member is formed with two block pieces connected by a pillar at the center thereof. The two block pieces have an interval therebetween which fits into the inverted U-shaped trough. A suction cup is connected to each of the block pieces.

3 Claims, 9 Drawing Sheets

STRUCTURE OF DOOR GUARD

RELATED APPLICATION

The present application is a continuation-in-part of U.S. patent application Ser. No. 08/993,625, filed on Dec. 18, 1997, abandoned.

FIELD OF THE INVENTION

The present invention relates generally to a door fixtures, and more particularly to a door guard for keeping the door in an opening position.

BACKGROUND OF THE INVENTION

The prior art door guard (as shown in FIGS. 1 and 2) available in the market includes two types each having a male member and a female member. FIG. 1 shows a first type which includes a thick headed male member 11 perpendicularly fixed to a back of a door 50 and a grip headed female member 10 which has a pair of elastic clip-on arms with a pair of small wheels 101 and 102 at their forward ends for smoothly receiving the thick head of the male member 11 as it enters into the grip head and then is gripped therein. The female member 10 is perpendicularly secured to a nearby wall 60 and keeps in alignment with the female member 10. So that when the door 50 opens to a maximum span, it is retained by the door guard without breaking away except that the door 50 is turned to a closed position again. FIG. 2 shows a second type of door guard which includes a ball headed male member 12 with magnet therein and a metallic female member 13 with a hemispherical depression in a forward end engageable to ball head 121 so as to be attracted by the female member 12. Since the first type is more reliable than the second type, the former is more popular than the latter in architectural design.

However, both of them have the same disadvantages set forth as follows:

a) it is difficult to align a male member with a female member when installing a door guard of the above types and takes time to make sure where is the position on the door back suitable to fix the male or female member. Besides, a poor alignment of the male member with the female member may cause a poor engagement between the members and hence damage the door guard.

b) when the small wheels 101 and 102 of the female member 10 are worn and fatigued, the clip-on arms will lose their gripping function after repeated operations.

SUMMARY OF THE INVENTION

The primary objective of the present invention is therefore to provide an improved structure door guard which is comprised of a fixed member provided at the front end of a connection body. Both ends of said fixed member are provided each with a suction body. The connection body and fixed member together with said suction body are stuck with the pad of the door to retain the door in open position.

The foregoing objective, features and functions of the present invention will be more readily understood upon a thoughtful deliberation of the following detailed description of a preferred embodiment of the present invention with reference to the accompanying drawings.

DETAILED DESCRIPTION OF THE INVENTION

Figure 2:
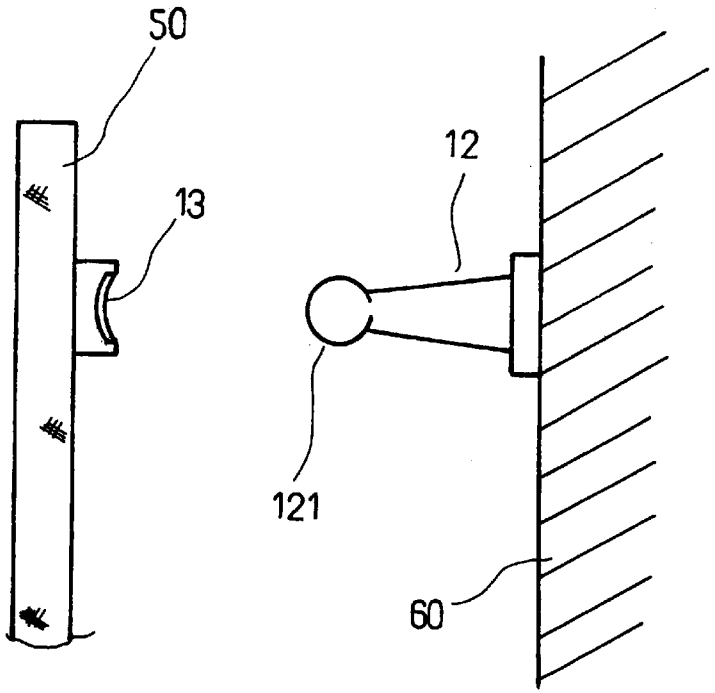
FIG 2 PRIOR ART
FIG. 2 shows another schematic structure view of the prior art door guard.
Figure 1:
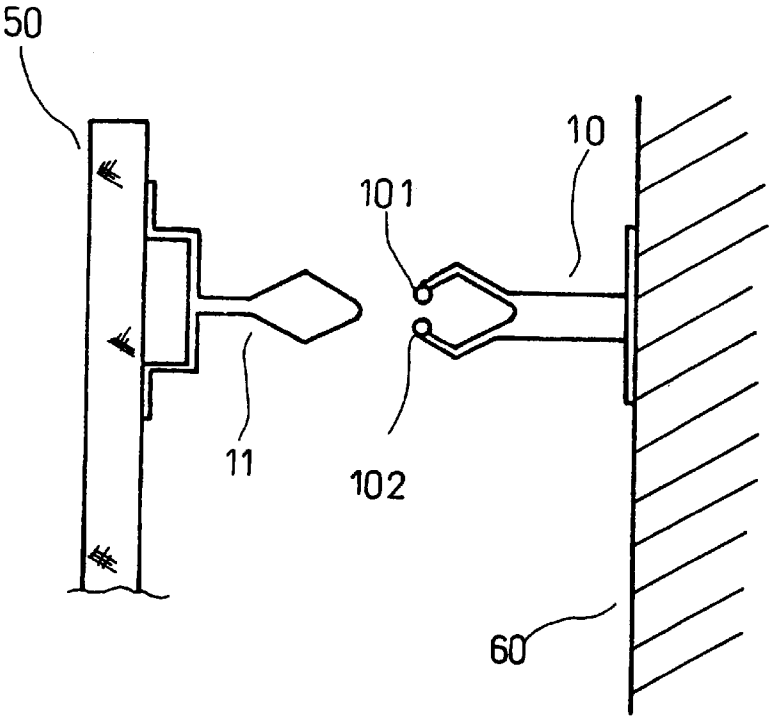
FIG 1 PRIOR ART
FIG. 1 shows a schematic structure view of a prior art door guard.
Figure 3:
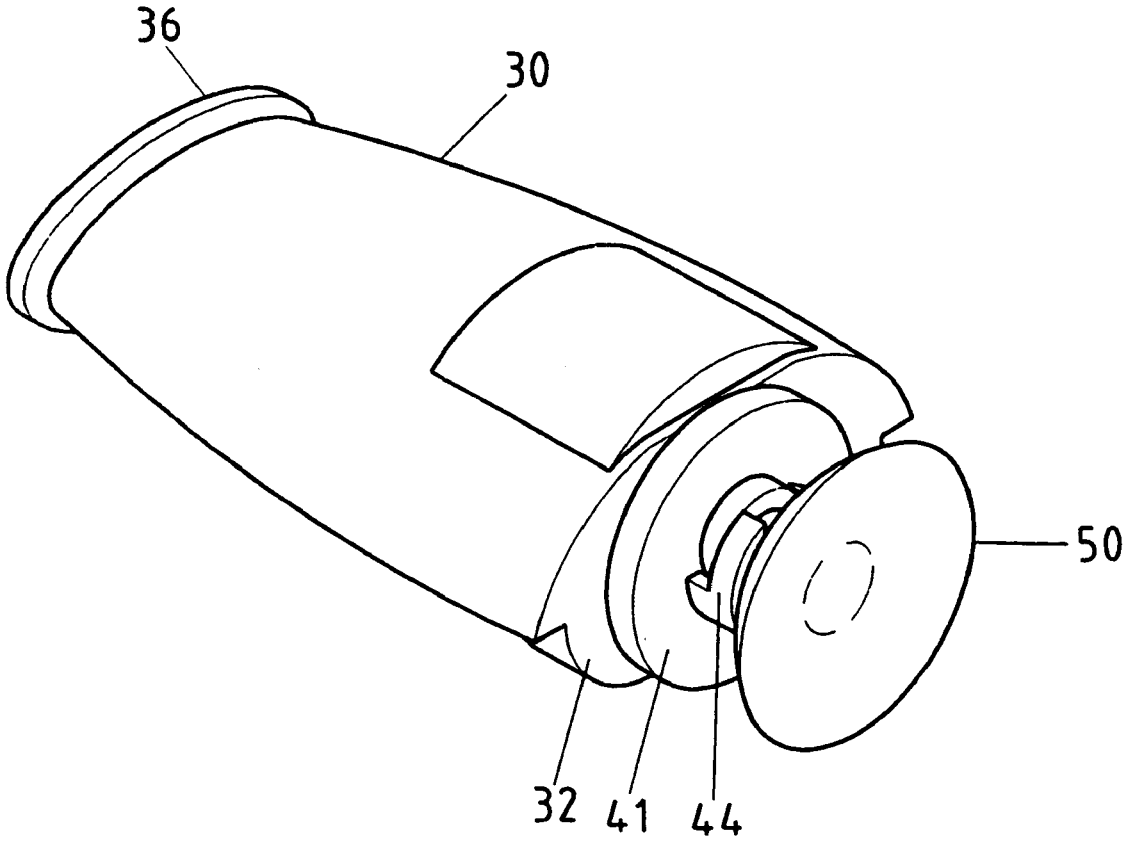
FIG. 3 shows a perspective view of the present invention in combination.
Figure 4:
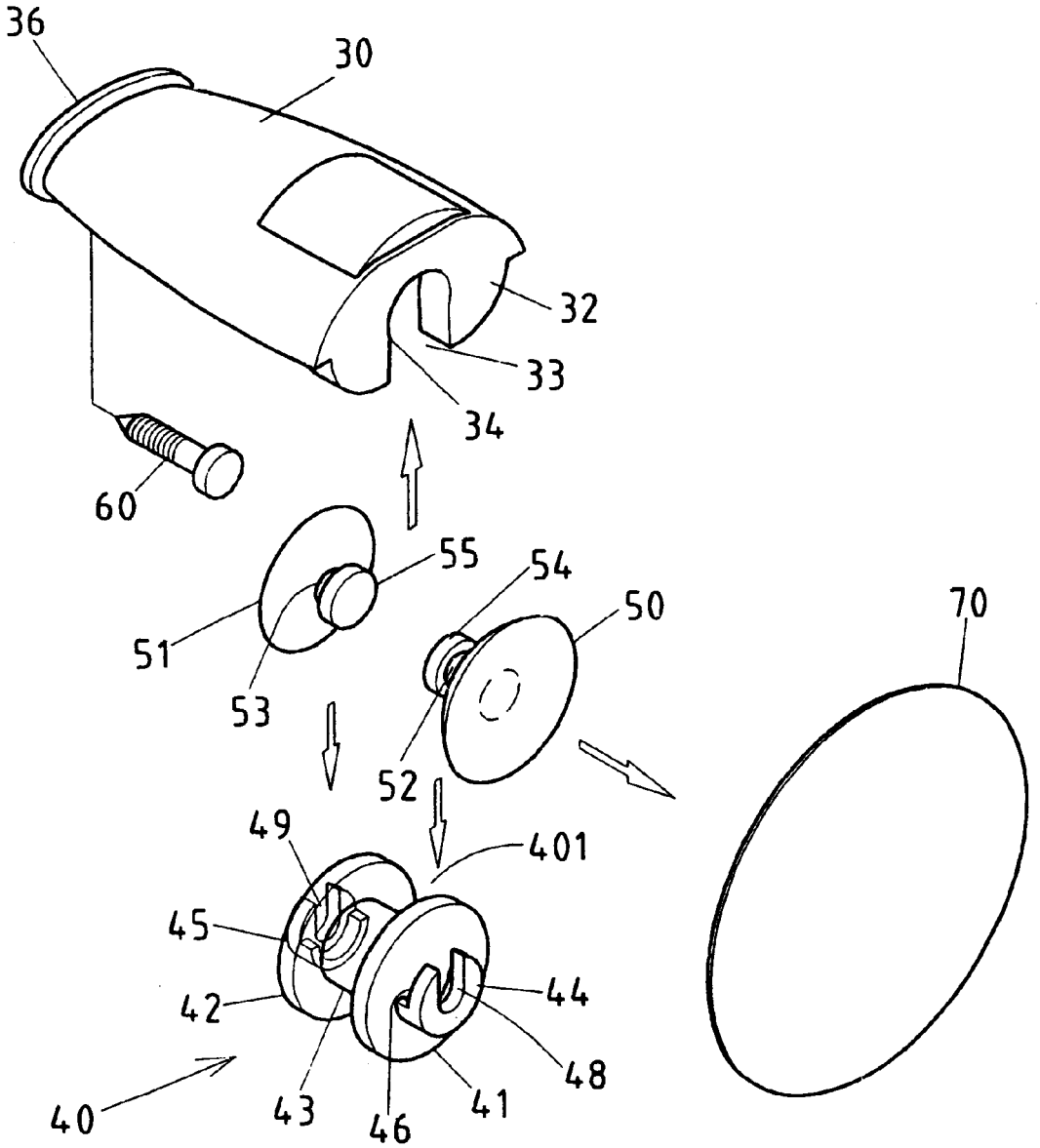
FIG. 4 shows an exploded view of the present invention.
Figure 5:
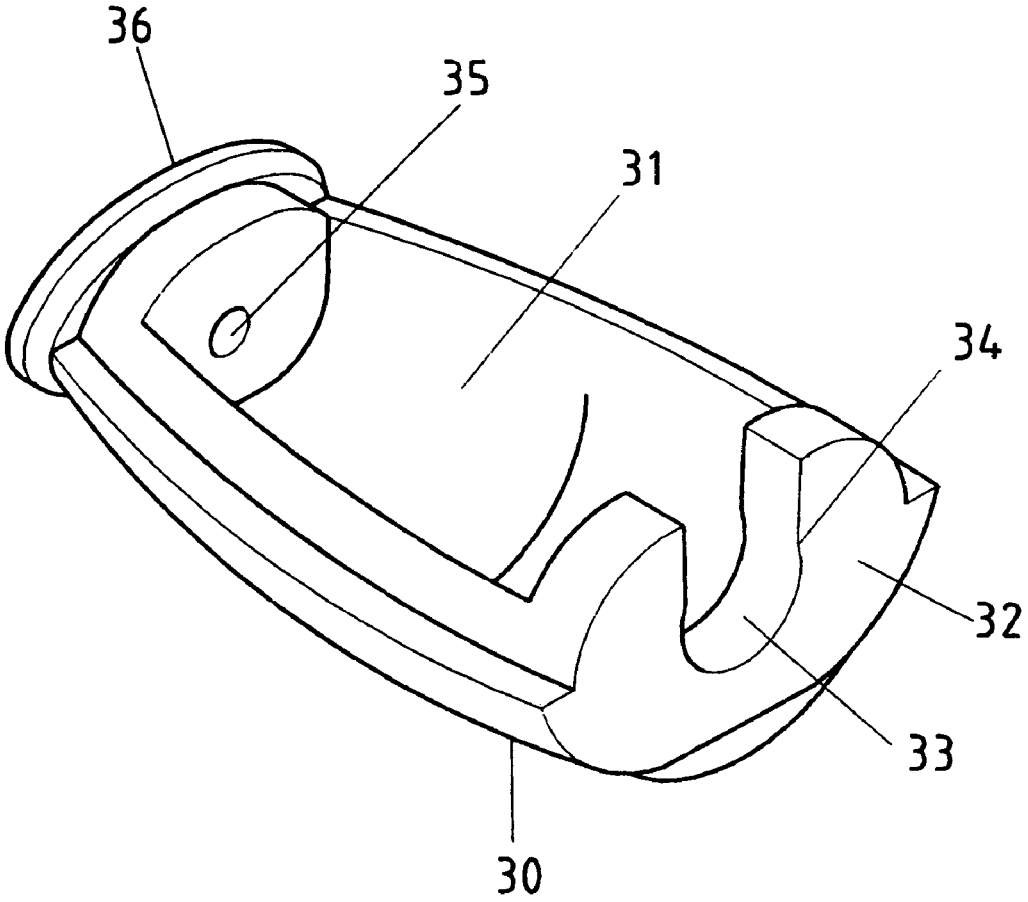
FIG. 5 shows a perspective view of a connection body of the present invention.
Figure 6:
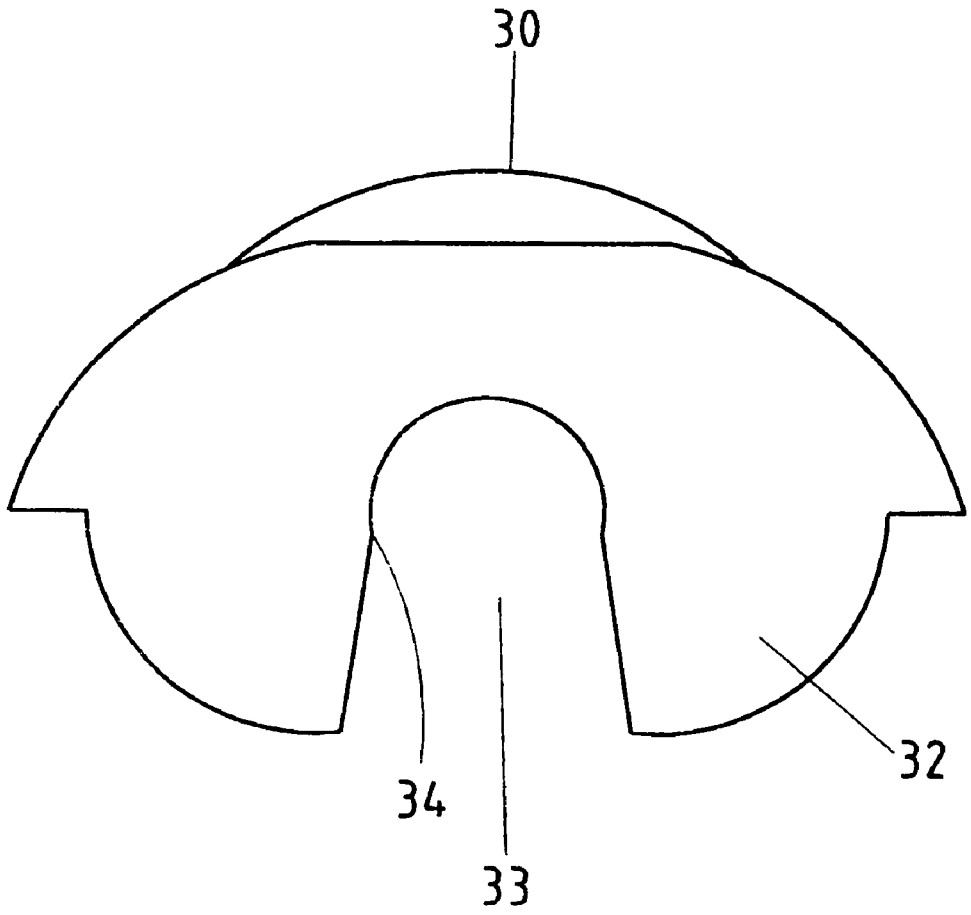
FIG. 6 shows a schematic end view of the connection body of the present invention.
Figure 7:
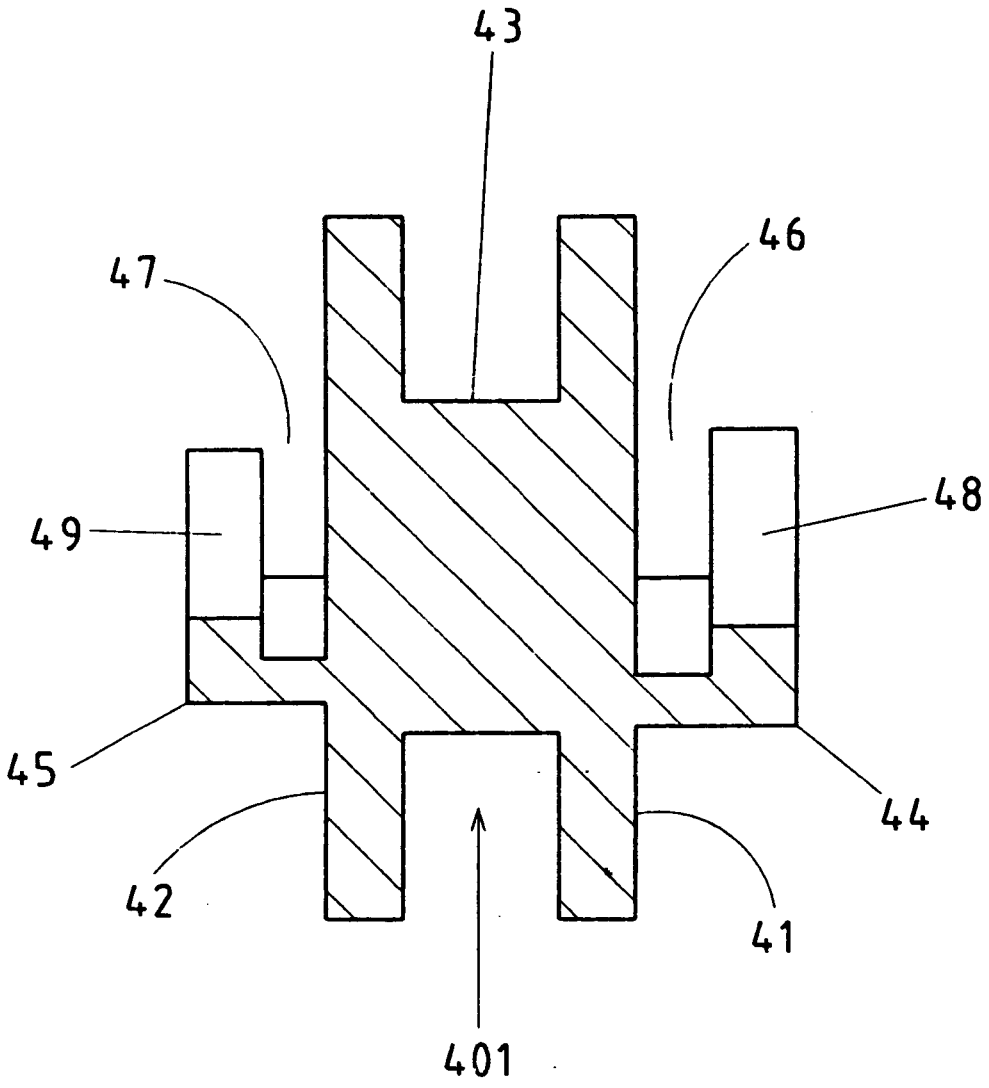
FIG. 7 shows a schematic view of a fixed member of the present invention.
Figure 8:
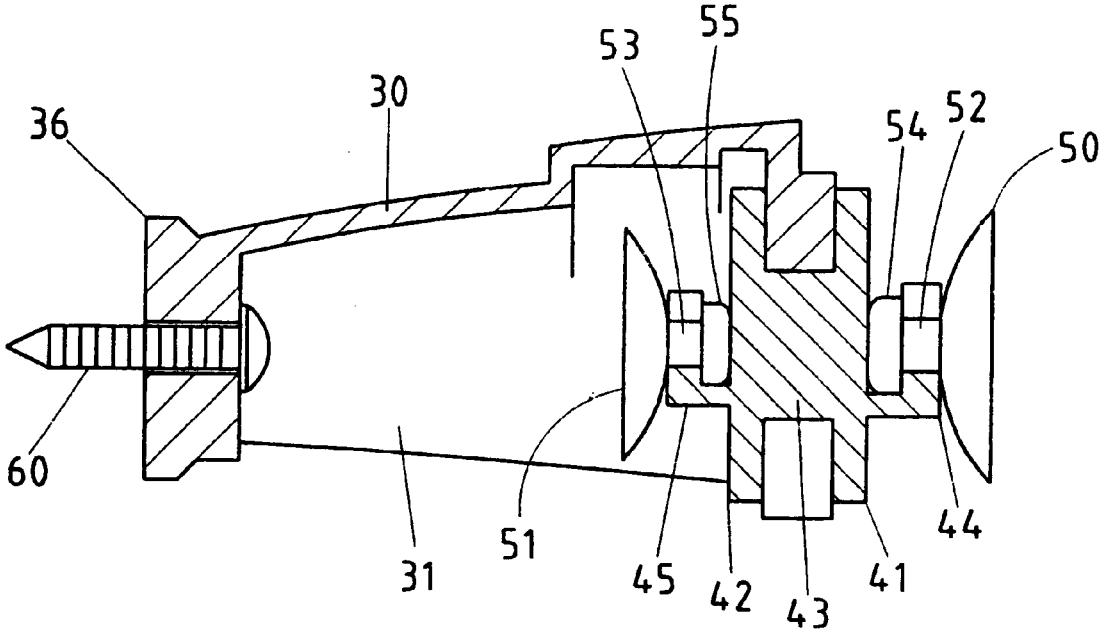
FIG. 8 show a sectional view of the present invention in combination.

As illustrated in FIGS. 3–8, the present invention of structure door guard is comprised of a connection body 30, a fixed member 40, two suction body 50, 51 and a pad 70.

The connection body 30 is a hollow trough 31 at the underside thereof. At the front end of connection body 30 is formed a front wall 32, which is provided at center from the bottom edge to upright with a inverted U-shaped trough 33 that its both sides wall formed relatively convex arc 34. In addition, at the rear end of connection body 30 is formed an back wall 36, which is provided at center with a through hole 35 through to inside of hollow trough 31 of connection body 30.

The fixed member 40 is provided with two relative block pieces 41, 42 which connected by a pillar 43 at center. The interval 401 between two relative front pieces 41, 42 sets fit into the block wall 32 of front end connection body 30. Moreover, at outer side of two relative block pieces 41, 42 are provided centrally each with a protruding brackets 44, 45. Between the protruding brackets 44, 45 and two relative block pieces 41, 42 are formed receiving trough 46, 47. An U-shaped trough 48, 49 is formed on the outer wall of protruding brackets 44, 45 and connected with receiving trough 46, 47. So that the fixed member 40 takes the advantages of interval 401 to enable the pillar 43 embeds and fixes into the inverted U-shaped trough 33 of front end connection body 30, and further to let the receiving trough 46, 47 and U-shaped trough 48, 49 face upward.

The two suction body 50, 51 are formed centrally each with a connection members 52, 53 at one side thereof, and at the end of connection members 52, 53 further provided with an expanded stop ring 54, 55. The two suction body 50, 51 take the advantage of both connection members 52, 53 and stop ring 54, 55 to be embedded separately into the protruding bracket 44, 45 of both ends fixed member 40, and further to be inserted and fixed into the receiving trough 46, 47 and U-shaped trough 48, 49. In the meantime, one of the two suction body 50 locates at front end of connection body 30, and the other one of two suction body 51 locates inside the hollow trough 31 of connection body 30. A screw 60 comes from inside hollow trough 31 of connection body 30 through to through hole 35 of base 36 for fixing said connection body 30 on the wall that faces to the back side of door.

The pad 70 is smooth appearance flat shape composing plastic or iron material. The pad 70 is glued to the back side of door and faced to the suction body 50 of front end connection body 30.

The feature of the present invention has the fixed member 40 for its one end protruding bracket 44 and the receiving trough 46 of protruding bracket 44 together with the U-shaped trough 48 is rather big. However, for other end protruding bracket 45 and receiving trough 47 together with the U-shaped trough 49 is rather small.

The other feature of the present invention wherein the two suction body 50, 51 in order to match with the different sizes of protruding bracket 44, 45 of fixed member 40 to form therefore with one suction body 50 is big, and other suction body 51 is small.

Figure 9:
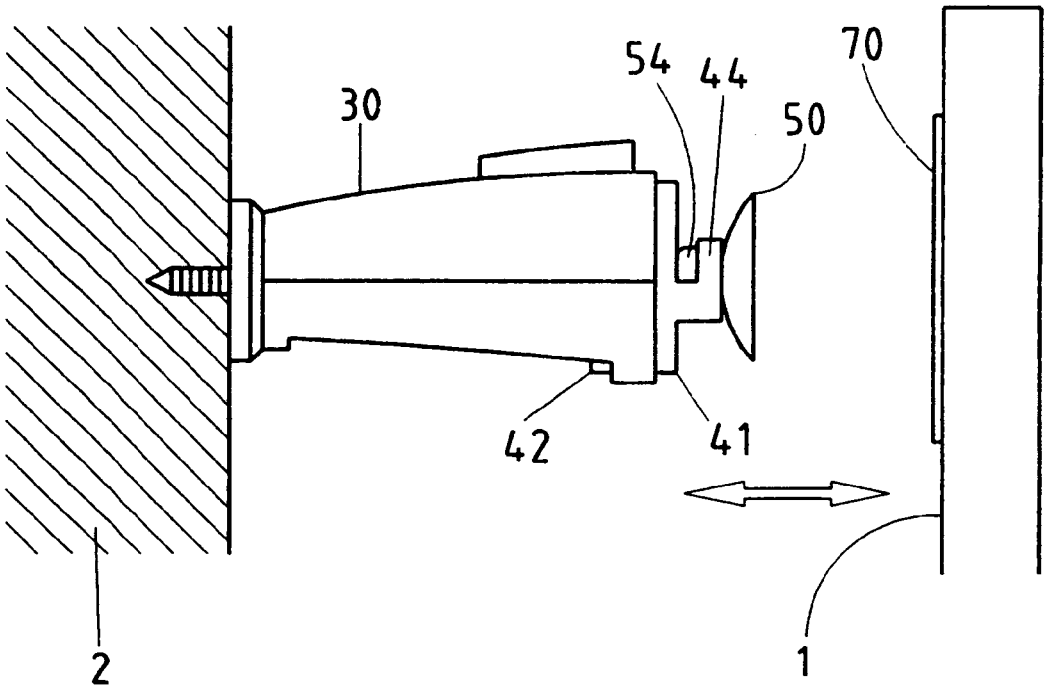
FIG. 9 shows a schematic install view of the present invention in using condition.
Figure 10:
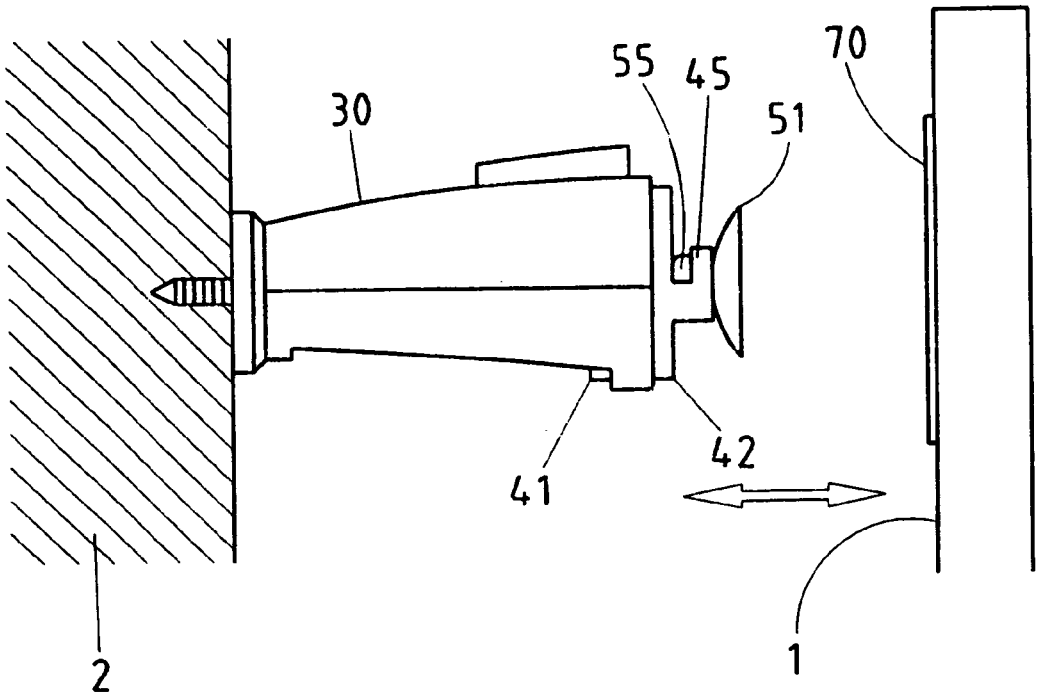
FIG. 10 shows another schematic install view of the present invention in using condition.

As illustrated in FIGS. 9 and 10, the present invention has advantages over the prior art. Such advantages in use are described hereinafter.

1. When the door 1 is opened, the suction body 50 of front end connection body 30 can adhere directly the pad 70 of the back door 1. It is therefore to fix the door 1 in place and to decrease the bump noise while fixing the door 1.

2. For matching the different sizes and weights of the door, it can pull out the fixed member 40 from the block wall 32 of front end connection body 30, then change the toward direction of fixed member 40 for choosing the small or big size of two suction body 50, 51 fixing at the front end connection body 30. It is therefore able to adhere and fix to the different size of door.

3. The composing of connection body 30 and fixed member 40 is very easy and simple to fix on the wall 2. Besides, the pad 70 is just glued on the back of door 1 facing to the suction body 50. It is therefore convenient in installing that the users can do it themselves.

The embodiment of the present invention described above is to be deemed in all respects as being illustrative and not restrictive.

What is claimed is:

1. A guard for a door comprising:

a connection body having a hollow trough formed at an underside thereof, said connection body having a front wall at one end thereof, said front wall having an inverted U-shaped trough formed centrally thereof, said connection body having a back wall at an opposite end thereof said back wall having a through hole formed centrally thereof, said through hole opening to said hollow trough;

a fixed member having two block pieces connected together by a pillar, said pillar affixed centrally to each of said two block pieces, an interval between said two block pieces fitting into said inverted U-shaped trough in said front wall, each of said two block pieces having a protruding bracket extending from an outer surface thereof, a receiving trough being formed between said outer surface and said protruding bracket, said protruding bracket having a U-shaped trough formed therein, said U-shaped trough and said receiving trough having an opening facing upwardly;

two suction cups each formed with a connector member at one side thereof, said connector member having a stop ring connected thereto at an end opposite said one side, said stop ring having a diameter greater than said connector member, said connector member and said stop ring being received respectively into said U-shaped trough and said receiving trough of said fixed member, one of said two suction cups being positioned outwardly of said front wall, another of said two suction cups positioned within said hollow trough of said connection body;

a screw extending through said through hole of said back wall, said screw adapted to secure said connection body to a surface; and a smooth flat pad positioned so as to face said one of said two suction cups, said pad being formed of a material selected from the group consisting of plastic and iron.

2. The guard of claim 1, said receiving trough and said U-shaped trough on one side of said front wall having a radius which is greater than a radius of said receiving trough and said U-shaped trough on an opposite side of said front wall.

3. The guard of claim 1, one of said two suction cups having a greater diameter then another of said two suction cups.

* * * * *